US005497557A

United States Patent [19]

Martinsson

[11] Patent Number: 5,497,557

[45] Date of Patent: Mar. 12, 1996

[54] CHAIN STRETCHING DEVICE FOR A CHAIN SAW

[75] Inventor: Pär B. G. Martinsson, Huskvarna, Sweden

[73] Assignee: Aktiebolaget Electrolux, Stockholm, Sweden

[21] Appl. No.: 313,014

[22] Filed: Sep. 27, 1994

[30] Foreign Application Priority Data

Oct. 13, 1993 [SE] Sweden ..... 9303363

[51] Int. Cl.[6] ..... B27B 17/14

[52] U.S. Cl. ..... 30/386

[58] Field of Search ..... 30/381, 382, 383, 30/384, 385, 386; 474/113, 114, 116; 83/816

[56] References Cited

U.S. PATENT DOCUMENTS 5,177,871 1/1993 Martenson .

FOREIGN PATENT DOCUMENTS 2509194 9/1975 Germany .
8306860 10/1988 Sweden .

*Primary Examiner*—Richard K. Seidel
*Assistant Examiner*—Charles Goodman
*Attorney, Agent, or Firm*—Pearne, Gordon, McCoy & Granger

[57] ABSTRACT

In a chain saw including a housing (10) and a guide bar (11) provided with a saw chain (16), the guide bar is releasably attached at one of its ends to the housing and axially slidable by means of an adjusting means to adjust the tension of the saw chain. The adjusting means comprises a screw (17) extending generally parallel to the guide bar and having one end attached to the housing in a non-rotatable manner, and a nut (18) engaging the screw and being operatively connected to the guide bar in order to provide an axial adjustment of the guide bar by rotation of the nut. The nut is rotated by means of a gear (19, 20) having a drive shaft (21) extending through a bore (22) in the guide bar.

4 Claims, 2 Drawing Sheets

CHAIN STRETCHING DEVICE FOR A CHAIN SAW

BACKGROUND OF THE INVENTION

The present invention relates to a device in a motor saw comprising a housing and a guide bar provided with a saw chain, said guide bar being releasably attatched at one end to the housing and axially slidable by means of an adjusting means in order to adjust the tension of the saw chain.

In order to adjust the axial position of the guide bar and thereby adjust the stretching of the chain it is common practice to use an adjusting screw extending parallel to the guide bar and actuating a stretching pin engaging a bore in the guide bar. The advantage of a screw device is that it is self-braking which facilitates the adjustment in that the adjusted position is maintained during tightening of the guide bar locking bolts, and also in that it contributes to maintaining the guide bar in its adjusted position during operation. The disadvantage is that the adjusting screw is not easily accessible whereby the adjusting is more circumstantial to carry out than would be preferable.

Another proposed arrangement comprises a gear wheel engaging a rack and having a shaft which extends through a bore in the guide bar and is thereby easily accessible for adjustment. A device of this type is described in DE 4104576. The disadvantage of this device, however, is that it is not self-braking which makes it difficult to maintain the guide bar in its adjusted position.

SUMMARY OF THE INVENTION

The object of the present invention is to provide a chain stretching device in which the disadvantages mentioned above have been eliminated. This has been achieved by means of a device in a motor saw which according to the invention is characterized in that the adjusting means comprises a screw extending generally parallel to the guide bar and being attached at one end in a non-rotatable manner to the housing, and a nut engaging the screw and operatively connected to the guide bar in order to provide an axial displacement of the guide bar by rotation of the nut, the nut being rotatably actuated by a gear transmission provided with a drive shaft extending through a bore in the guide bar.

BRIEF DESCRIPTION OF THE DRAWINGS

The invention will be described in more detail in the following with reference to the accompanying drawings, in which.

DETAILED DESCRIPTION OF THE PREFERRED EMBODIMENT

Figure 1:
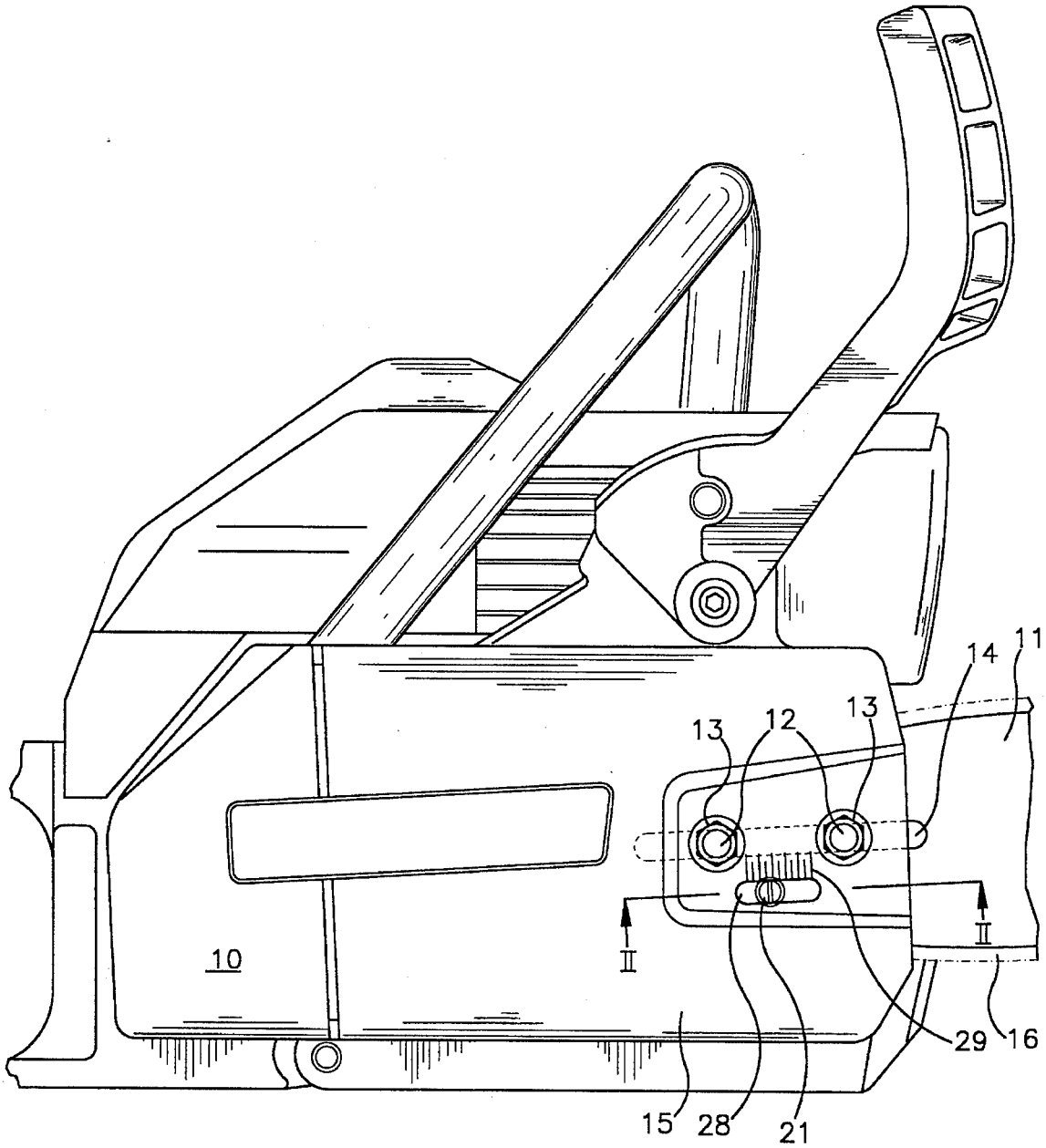
FIG. 1 is a partial side elevation of a motor saw provided with the device according to the invention.

The motor saw shown in the drawings comprises a housing 10 to which a guide bar 11 is releasably attached by means of two guide bar bolts 12 provided with locking nuts 13. The bolts 12 extend through an elongated opening 14 in the guide bar, and through corresponding bores in a coupling cover 15 which is also clamped by means of the same bolts. The opening allows displacement of the guide bar in a longitudinal direction in order to enable adjustment of the tension of a saw chain 16 which is diagramatically shown in the drawing.

Figure 2:
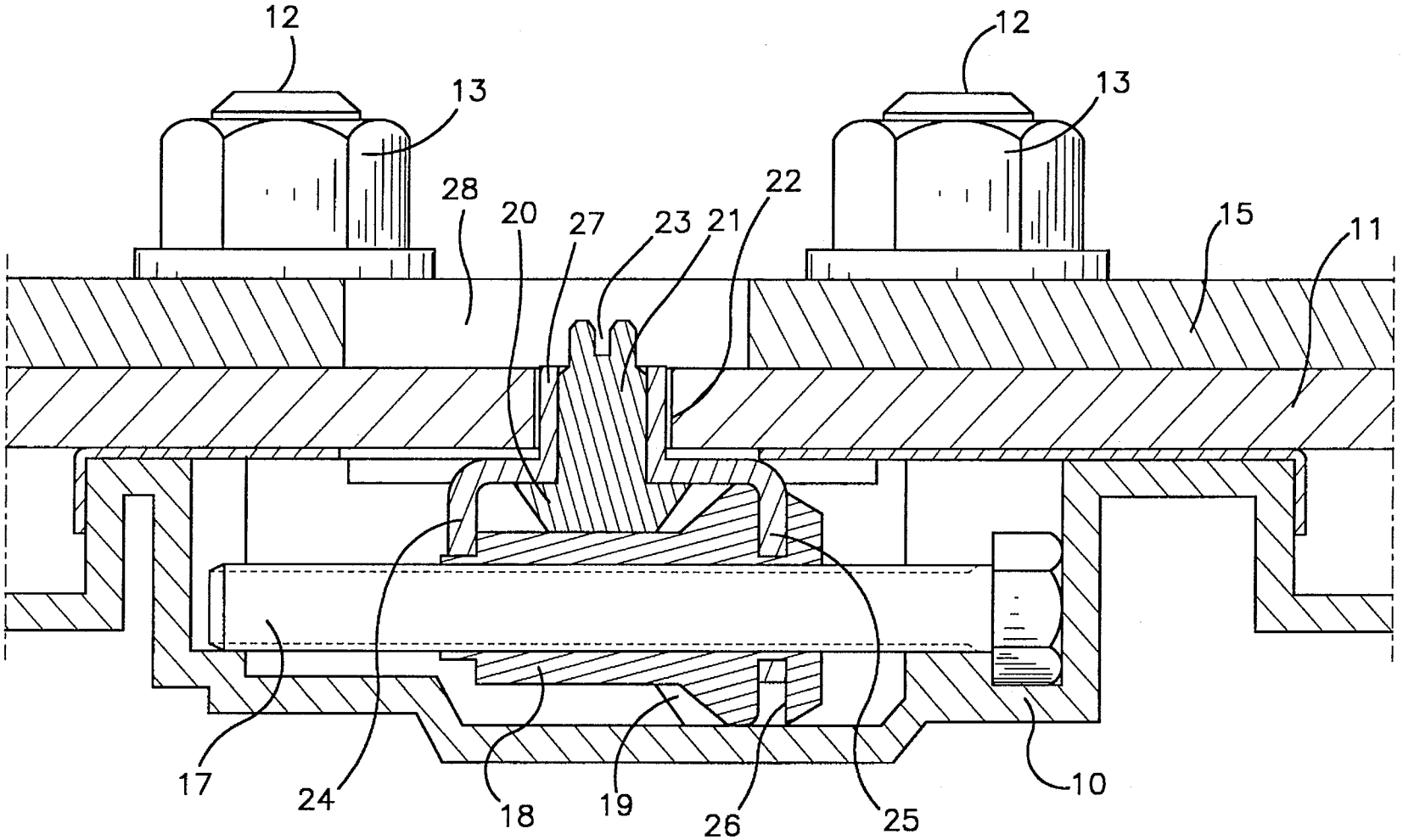
FIG. 2 is a partial longitudinal section on a larger scale taken along line II—II in FIG. 1.

With reference to FIG. 2, the adjusting device comprises a screw 17 one end of which is attached to the housing 10 in a non-rotatable manner. The screw 17 engages a nut 18 made integral with a first gear 19 which in turn meshes with a second gear 20. The last mentioned gear has a drive shaft 21 which extends through a bore 22 in the guide bar and is provided with a groove 23 to enable rotation of the gear 20 by means of a screwdriver. The two intermeshing gears form a bevel-gear which is provided in a bracket 24 comprising a U-shaped flange 25 engaging in a radial groove 26 in the nut 18, and a tubular portion 27 extending through the bore 22 in the guide bar and surrounding the shaft 21 of the gear 20.

In order to adjust the axial position of the guide bar and thereby the tension of the saw chain, the locking nuts 13 are loosened and the shaft 21 of the gear 20 is subsequently rotated by means of a screwdriver (not shown). The coupling cover 15 is provided with an elongated opening 28 through which the shaft 21 is accessible. The rotation of the gear 20 results in a corresponding rotation of the gear 19 and the nut 18 which is thereby displaced axially. The axial movement is transferred via the bracket 24 to the guide bar. Since the axial force is transferred from the screw 17 and the nut 18 to the guide bar via the bracket 24, the tubular portion 27 of which engages the bore 22 of the guide bar, the shaft 21 of the gear 20 will not be subjected to any adjustment forces. When the correct chain tension has been adjusted, the locking nuts 13 are tightened. Since the adjusting device is self-braking, the adjusted position is maintained during tightening of the locking nuts, and during operation the self-braking action of the device also contributes to ensuring that the guide bar is fixed in this position.

The axial displacement of the guide bar also results in a corresponding displacement of the shaft 21. As shown in FIG. 1, the coupling cover 15 is provided with scale marks 29 adjacent the opening 28. As the position of the shaft 21 along the scale marks 29 can be easily observed, the operator can easily read the actual position of the guide bar with relation to an initial or reference position. The read position provides an indication of the elongation of the saw chain.

I claim:

1. A motor saw comprising a housing (10), a guide bar (11) provided with a chain saw (16), said guide bar being releasably attached at one end to the housing and axially slidable relative to said housing, and adjusting means for axially displacing said guide bar relative to said housing to adjust the tension of the chain saw, said adjusting means comprising a screw (17) extending generally parallel to the guide bar and attached at one end in a nonrotatable manner to the housing (10), and a nut (18) engaging the screw and operatively connected to the guide bar to 14 provide an axial displacement of the guide bar by rotation of the nut, and a gear transmission (19, 20) provided with a drive shaft (21) extending through a bore (22) in the guide bar, said nut (18) being rotatably actuatable by the gear transmission (19, 20).

2. Motor saw according to claim 1, wherein said gear transmission comprises a bevel-gear having a first gear (19) arranged to rotate the nut (18) and a second gear (20) interengaging the first gear and arranged to be rotated by the drive shaft (21).

3. Motor saw according to claim 1, wherein said gear transmission is provided in a bracket (24) operatively connected to the gear transmission and engaging the guide bar for transferring adjusting forces from the nut (18) to the guide bar (11).

4. Motor saw according to claim 1, further comprising scale marks (29) on said housing adjacent said adjustment means for indicating an axial position of the guide bar (11) relative to the housing.

* * * * *

UNITED STATES PATENT AND TRADEMARK OFFICE

CERTIFICATE OF CORRECTION

PATENT NO. : 5,497,557

DATED : March 12, 1996

INVENTOR(S) : Martinsson

It is certified that error appears in the above-indentified patent and that said Letters Patent is hereby corrected as shown below:

Column 2, line 48 (claim 1, line 10) delete "14".

Signed and Sealed this

Thirtieth Day of July, 1996

Bruce Lehman

*Attest:*

BRUCE LEHMAN

*Attesting Officer*

*Commissioner of Patents and Trademarks*